US005581839A

United States Patent [19]

Ferrell, Jr.

[11] Patent Number: 5,581,839

[45] Date of Patent: Dec. 10, 1996

[54] MOP HANDLE AND MOP

[76] Inventor: LeRoy Ferrell, Jr., 929 Old U.S. 52, New Richmond, Ohio 45157

[21] Appl. No.: 564,483

[22] Filed: Nov. 29, 1995

[51] Int. Cl.[6] ..... B25G 1/00

[52] U.S. Cl. ..... 15/143.1; 15/229.6

[58] Field of Search ..... 15/143.1, 228, 15/229.6, 229.2; 16/121, 113

[56] References Cited

U.S. PATENT DOCUMENTS

| | | | |
|---|---|---|---|
| 186,254 | 1/1877 | Jackson | 15/143.1 |
| 194,042 | 8/1877 | Jackson | 15/143.1 |
| 207,427 | 8/1878 | Lamboy | 15/143.1 |
| 277,298 | 5/1883 | Lincoln | 15/143.1 |
| 987,981 | 3/1911 | Gross | 15/143.1 |
| 1,609,414 | 12/1926 | Lenny | 15/143.1 |
| 2,619,368 | 11/1952 | Anderson | 15/143.1 |
| 2,677,838 | 5/1954 | Jouban | 15/229.6 |
| 2,887,712 | 5/1959 | Vosbikian et al. . | |
| 4,704,758 | 11/1987 | Hoffman . | |
| 4,930,181 | 6/1990 | Johnson . | |
| 4,958,407 | 9/1990 | Johnson . | |
| 5,133,101 | 7/1992 | Hauser et al. . | |
| 5,384,930 | 1/1995 | Uno . | |

*Primary Examiner*—Timothy F. Simone
*Assistant Examiner*—James F. Hook
*Attorney, Agent, or Firm*—Charles R. Wilson

[57] ABSTRACT

A mop handle and mop are designed to result in lessened muscle strain to the user. The mop handle comprises a substantially straight elongated shaft with an upper sleeve positioned over one end of the shaft and a lower sleeve positioned over a mid-portion of the shaft. Each sleeve is rotatably secured to the elongated shaft so that during use of the mop, the elongated shaft of the mop handle is free to move with the mop head, yet the movement is not transferred to the user. This results in the lessened muscle strain and reduced hand blister formation.

14 Claims, 3 Drawing Sheets

MOP HANDLE AND MOP

This invention relates to a mop handle. More particularly, the invention relates to a mop handle and a mop having the ability to lessen muscle strain during use.

BACKGROUND OF INVENTION

Mops are very prevalent and have been for many years. A mop with a string-type mop head in particular is well known. Such mops are used in the home to clean hard surface areas such as kitchen floors and bathroom floors. They are also extensively used in industrial and commercial buildings to clean floors.

Anyone who has used a string-type mop for even a short period of time can attest to the fact it causes a certain amount of hand and arm muscle fatigue. Blisters on the hands can also occur unless proper care is taken, e.g. wearing work gloves or mopping a small area. Professional maintenance people who may use the mop for long periods of time and for several days at a time are well aware of muscle strain and blister problems that are likely to occur. However, the conventional string-type mop which has been used for many years is a very effective cleaning implement. Its advantages far outweigh its disadvantages. As a result, it remains in use. Those who use it have accepted its disadvantages and have suffered through the muscle strain problem in particular.

There have been limited attempts to improve the conventional string-type mop. U.S. Pat. Nos. 2,887,712 and 5,133,101 disclose two such attempts. The mop disclosed in U.S. Pat. No. 2,887,712 utilize a rotary mop head attached to a mop handle. The mop head is free to rotate in use and is said to provide a better cleaning and polishing action. U.S. Pat. No. 5,133,101 also discloses an improved string-type mop, though its intent is specifically to facilitate manipulation of the mop head without causing muscle strain or injury to the user. An auxiliary set of struts or hand grips extend from a mid-portion of the mop's handle. It is said that a lateral spacing of the struts from the mop handle provides a moment arm which facilitates rotation of the mop head. The struts have coverings which are free to rotate. This is turn prevents abrasion and callousing of the user's hands. While apparently effective to a certain degree, it is also apparent that the auxiliary set of struts adds significantly to the cost of the mop. Additionally, muscle strain of a hand needed for an end of the mop handle is still present.

There remains a need for an improved string-type mop which is easy to use with due regard for the user's physical health. The mop must be economical to produce and most importantly must be able to reduce known muscle strain inherent with present string-type mops. In accord with this need, there has now been developed an improved mop handle and mop which result in less muscle strain to the user.

SUMMARY OF INVENTION

A mop handle and mop has the ability to lessen muscle strain in the hands and arms of the mop's user. The mop handle comprises a substantially straight elongated shaft with an upper cylindrical-shaped sleeve positioned over one end and a lower cylindrical-shaped sleeve positioned over a mid-portion of the shaft. Each of the sleeves is attached in a manner which allows it to freely rotate about the shaft. The mop comprised of the mop handle and a mop head is easy to use with lessened muscle strain to the user due to the free rotation of the sleeves on the elongated shaft. Rotational forces caused by the mop head as it is moved about on the floor are not transferred through the mop handle to the mop user. The mop still efficiently cleans the floor but with less exertion by the user.

DETAILED DESCRIPTION OF INVENTION

The mop handle and mop of the invention are described in detail in the following paragraphs and with particular reference to the drawings. The invention has particular use with string-type mops and, therefore, is described and illustrated. It should be understood the mop handle of the invention is useful with other mop heads and is contemplated for such other uses.

Figure 1:
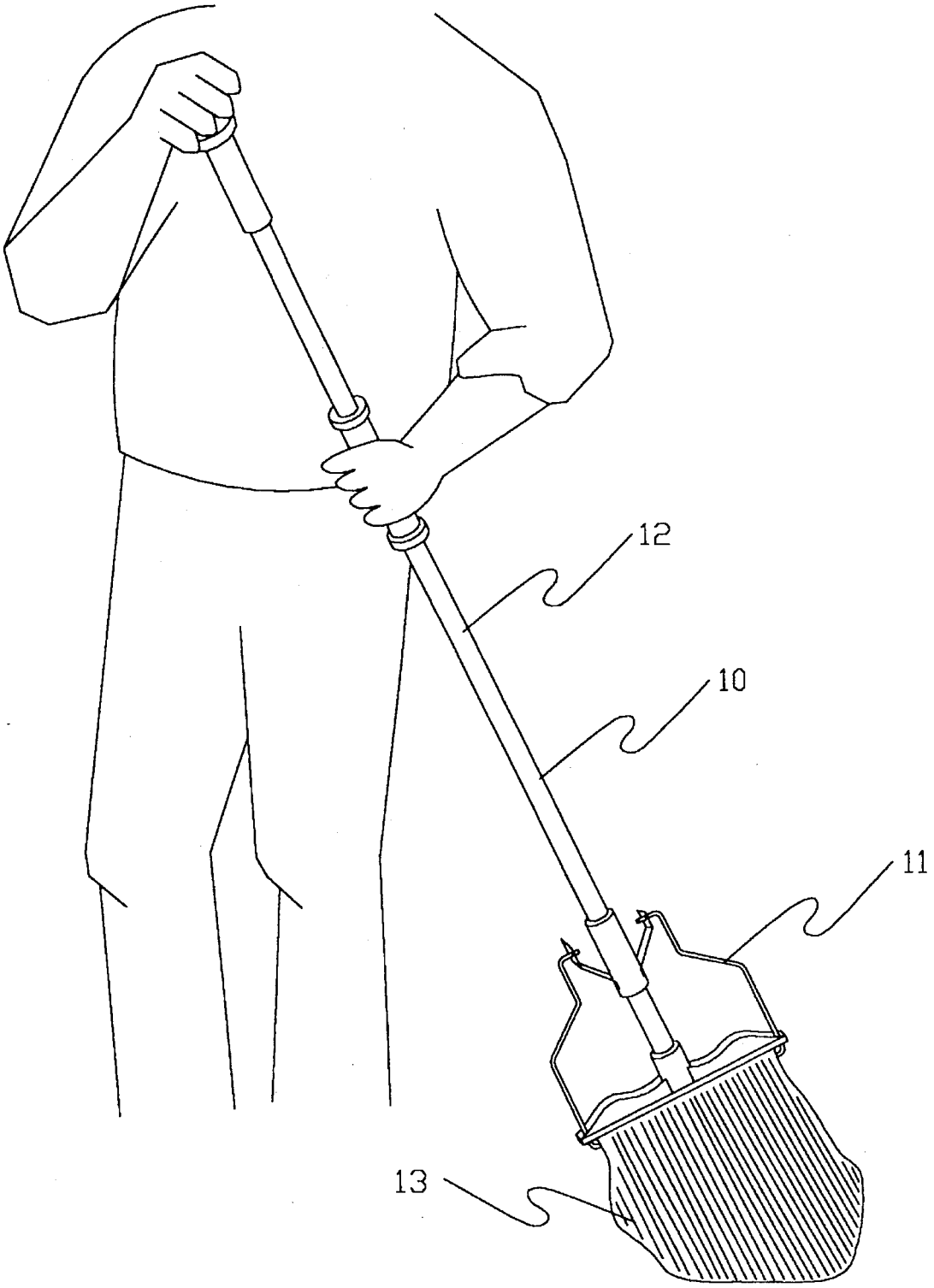
FIG. 1 is an environmental view of the mop handle and mop of the invention in use.

With reference to FIG. 1, there is shown a mop 10 of the invention in use. The mop 10 comprises a mop head 11 and a mop handle 12. The mop head 11 is conventional in design. It has a set of absorbent strands 13 held together at one end and attached to the mop handle so that each strand's free end is able to move in a dragging motion on the floor. The individual strands are preferably formed from a natural material such as cotton, though synthetic materials can as well be used. The strands can be formed from several yarns twisted together. They can also be strips of flattened absorbent material manufactured for cleaning purposes. Still other types of materials can form a mop head of this general nature. The manner in which the individual strands are held together is also conventional, as is the fixed attachment of the mop head to the elongated shaft.

Figure 2:
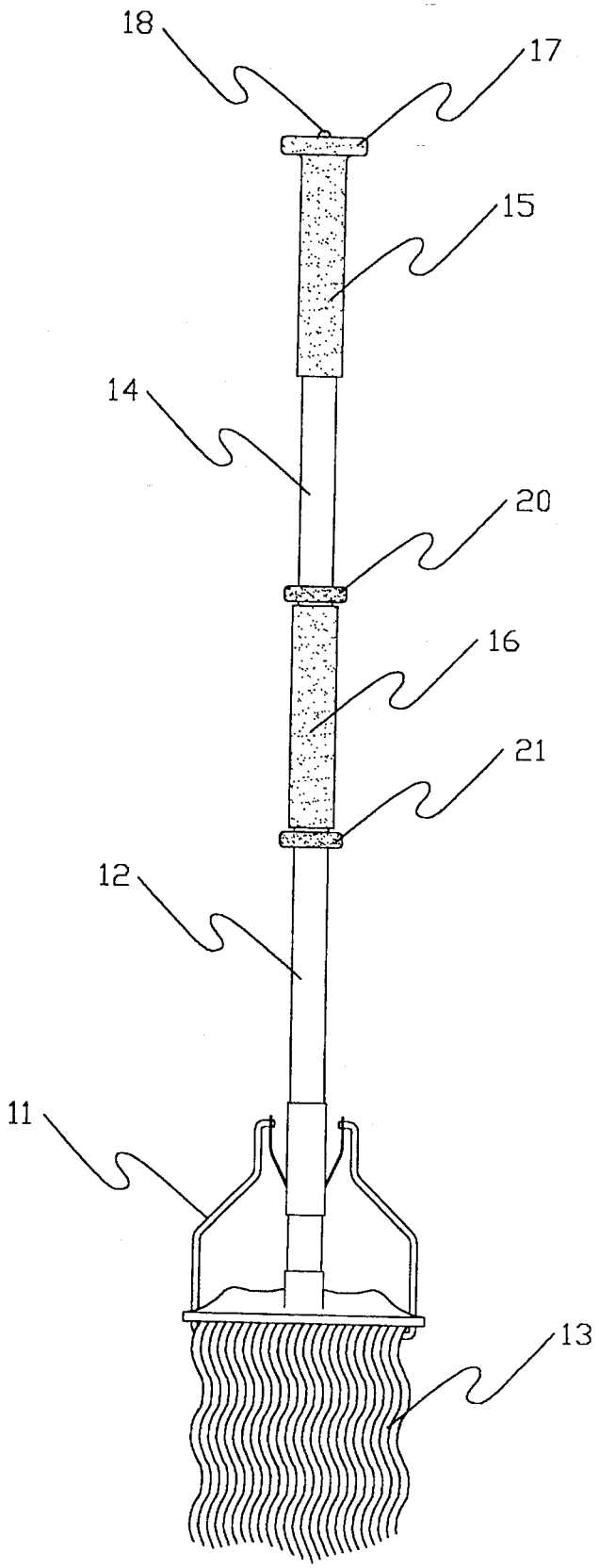
FIG. 2 is an elevational view of the mop of FIG. 1.

The mop handle 12 of the invention used with the mop head 11 is best seen in FIG. 2. It comprises a substantially straight elongated shaft 14, an upper cylindrical-shaped sleeve 15 and a lower cylindrical-shaped sleeve 16. A first end of the shaft has the mop head attached thereto. The elongated shaft is typically made of wood. Plastic or metal can also be used in making the elongated shaft. It is about four feet to about six feet in length and preferably has a circular cross-section of about 0.75 inches to about 1.5 inches in diameter.

Figure 3:
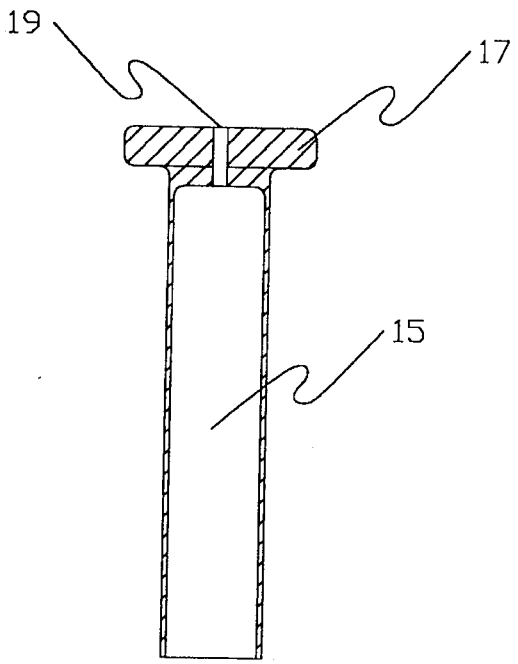
FIG. 3 is a sectional side view of an upper cylindrical-shaped sleeve forming a part of the mop handle of FIG. 2.

The upper cylindrical-shaped sleeve 15 is dimensioned to fit onto the end of the elongated shaft and rotate freely. The sleeve's inside diameter accordingly is slightly larger than the diameter of the elongated shaft. The sleeve's length is sufficiently long to allow the user's hand to fully fit onto it. About four inches to about eight inches in length is adequate. Preferably, and as shown in FIG. 3, the upper sleeve 15 has a knob 17 which is integral. That is, the upper sleeve and knob are one-piece. The knob covers the terminus of the elongated shaft. It has a flattened top surface with a greater diameter than the elongated shaft. It provides a degree of hand comfort to the user by presenting a broader, less pointed surface for contact with the palm of the user's hand.

A screw 18 extends through a hole 19 in the knob 17 and longitudinally into the elongated shaft 14. It loosely holds the knob and upper sleeve in place such that they freely rotate about the elongated shaft. Other attachment means for rotatably holding the upper sleeve to the elongated shaft can be used. For example, a nail or peg can be used in place of the screw 18.

It should be understood a knob on the terminus of the elongated shaft can be fixed thereto and a separate upper sleeve positioned directly below it. Such a sleeve can be rotatably secured to the elongated shaft by use of a ring permanently fixed to the shaft below the upper sleeve. The sleeve in this instance is trapped between the fixed knob and the fixed ring. Further description of a ring is found below with respect to the lower cylindrical-shaped sleeve 16.

Figure 4:
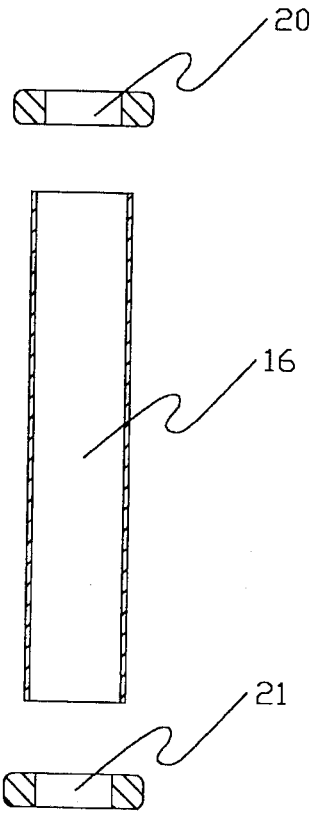
FIG. 4 is a sectional side view of a lower cylindrical-shaped sleeve forming a part of the mop handle of FIG. 2.

As evident in FIG. 2, the lower cylindrical-shaped sleeve 16 is positioned on a mid-portion of the elongated shaft 14 where the user grabs naturally. It has a length sufficiently long to fully receive the user's hand and an inside diameter slightly larger than the diameter of the elongated shaft. Preferably, as with the upper sleeve, the lower sleeve has a length of from about four inches to about eight inches. With reference to FIGS. 2 and 4, the lower sleeve 16 is rotatably held to the elongated shaft by a set of rings which are fixed to the elongated shaft. One ring 20 is fixed to the shaft just above the lower sleeve. A second ring 21 is fixed to the shaft just below the sleeve. In effect, the lower sleeve is trapped between the two fixed rings. Sufficient tolerances are present to allow the sleeve to freely rotate. Washers can optionally be used between each ring and the sleeve to reduce friction.

It should be evident that the upper and lower sleeves of the mop handle are grasped by the mop's user. The mop is used in the ordinary fashion. However, because of the rotatable nature of the two sleeves, the mop's elongated shaft will freely rotate in response to movement of the mop head. The sleeves themselves do not rotate in the user's hands. As a result, the circular twisting motion of the mop head is not transferred to the user's hands. Lessened muscle strain in the hands and forearms of the user is immediately experienced. Additionally, a rubbing movement on the hands is not experienced. Necessarily, blister do not form. Extended use of the mop of the invention confirms a substantial reduction in user muscle strain.

While the invention has been described in detail and with reference to the drawings, it should be understood various modifications can be made. Other changes of an obvious nature are considered within the scope of the appended claims.

I claim:

1. A mop handle for attachment to a mop head to form a mop whereby a user of the mop experiences less muscle strain and blister formation, comprising:

(a) a substantially straight elongated shaft having a first end for attachment to the mop head and a second end;

(b) an upper cylindrical-shaped sleeve positioned over the second end of the elongated shaft and rotatably secured thereto, said upper cylindrical-shaped sleeve for grasping by the user; and (c) a lower cylindrical-shaped sleeve positioned over a mid-portion of the elongated shaft and rotatably secured thereto, said lower cylindrical-shaped sleeve for grasping by the user.

2. The mop handle of claim 1 wherein each cylindrical-shaped sleeve has a length of from about four inches to about eight inches.

3. The mop handle of claim 2 wherein the upper cylindrical-shaped sleeve further has a knob attached at an end thereof whereby the knob has a flattened top surface and overlies a terminus of the elongated shaft.

4. The mop handle of claim 3 wherein the upper cylindrical-shaped sleeve and the knob are one piece and further whereby an attachment means extends through the knob and into the elongated shaft in a manner which allows said upper cylindrical-shaped sleeve and knob to rotate freely.

5. The mop handle of claim 1 wherein the lower cylindrical-shaped sleeve is rotatably secured to the elongated shaft by a first ring permanently secured to the elongated shaft at one end of said sleeve and a second ring permanently secured to the elongated shaft at another end of said sleeve such that said sleeve is trapped between said first and second rings.

6. A mop having means for reducing muscle strain and hand blister formation in both hands of a user, comprising:

(a) a mop handle with (i) a substantially straight elongated shaft having a first end and a second end, (ii) an upper cylindrical-shaped sleeve positioned over the second end of the elongated shaft and rotatably secured thereto for grasping by the user, and (iii) a lower cylindrical-shaped sleeve positioned over a mid-portion of the elongated shaft and rotatably secured thereto for grasping by the user; and (b) a mop head secured to the first end of the mop handle, whereby use of the mop reduces muscle strain in the user by allowing the mop head to move without a substantial transference of a circular twisting motion from the mop head to the user's hands.

7. The mop of claim 6 wherein each cylindrical-shaped sleeve of the mop handle has a length of from about four inches to about eight inches.

8. The mop of claim 7 wherein the upper cylindrical-shaped sleeve of the mop handle further has a knob attached at an end thereof whereby the knob has a flattened top surface and overlies a terminus of the elongated shaft.

9. The mop of claim 8 wherein the upper cylindrical-shaped sleeve and the knob of the mop handle are one piece and further whereby an attachment means extends through the knob and into the elongated shaft in a manner which allows said upper cylindrical-shaped sleeve and knob to rotate freely.

10. The mop of claim 6 wherein the lower cylindrical-shaped sleeve of the mop handle is rotatably secured to the elongated shaft by a first ring permanently secured to the elongated shaft at one end of said sleeve and a second ring permanently secured to the elongated shaft at another end of said sleeve such that said sleeve is trapped between said first and second rings.

11. A mop having means for reducing muscle strain and hand blister formation, comprising:

(a) a mop handle with (i) a substantially straight elongated shaft with a circular cross-section of about 0.75 inches to about 1.5 inches in diameter and having a first end and a second end, (ii) an upper cylindrical-shaped sleeve having a length of from about four inches to about eight inches positioned over the second end of the elongated shaft and rotatably secured thereto, and (iii) a lower cylindrical-shaped sleeve having a length of from about four inches to about eight inches positioned over a mid-portion of the elongated shaft and rotatably secured thereto; and (b) a mop head secured to the first end of the mop handle, whereby the user of the mop grasps the upper and lower cylindrical-shaped sleeves during use and further whereby the mop head moves without a substantial transference of a circular twisting motion from the mop head to the user's hands.

12. The mop of claim 11 wherein the upper cylindrical-shaped sleeve of the mop handle further has a knob overlying a terminus of the elongated shaft and integral with said upper cylindrical-shaped sleeve.

13. The mop of claim 12 further wherein the knob on the upper cylindrical-shaped sleeve has a flattened top surface and a diameter greater than the diameter of the elongated shaft.

14. The mop of claim 13 wherein the lower cylindrical-shaped sleeve of the mop handle is rotatably secured to the elongated shaft by a first ring permanently secured to the elongated shaft at one end of said sleeve and a second ring permanently secured to the elongated shaft at another end of said sleeve such that said sleeve is trapped between said first and second rings.

* * * * *